United States Patent [19]

Bezdek

[11] Patent Number: 4,985,932

[45] Date of Patent: Jan. 22, 1991

[54] FOOD SPILL CATCHING AND SERVING DEVICE

[76] Inventor: William J. Bezdek, 2861 Hagadorn Rd., Mason, Mich. 48854

[21] Appl. No.: 516,446

[22] Filed: Apr. 30, 1990

[51] Int. Cl.[5] ..... A41B 13/10; A41D 13/04

[52] U.S. Cl. ..... 2/049 A; 224/202; 224/270; 224/906; 2/49 R; 229/114; 229/2.5 R; 229/145

[58] Field of Search ..... 224/202, 270, 906; 2/48, 49 A, 49 R, 50, 51, 52; 229/2.5 R, 114, 145

[56] References Cited

U.S. PATENT DOCUMENTS

| | | | |
|---|---|---|---|
| 2,704,625 | 3/1955 | Huse | 224/906 |
| 4,887,315 | 12/1989 | Bezdek | 2/49 A |
| 4,915,278 | 4/1990 | Smith | 224/202 |
| 4,930,681 | 6/1990 | Fultz et al. | 229/114 |

*Primary Examiner*—Henry J. Recla
*Assistant Examiner*—Robert C. Lawson
*Attorney, Agent, or Firm*—Ian C. McLeod

[57] ABSTRACT

An improved food spill catching device (10) with folded straps (12) mounted in a tray portion 10*c* for attaching the device around the neck of a person is described. The device is preferably provided by forming the straps 12 and trays (10*b* and 10*c*) separately as preforms (20 and 30) which are then assembled and formed into the device.

13 Claims, 3 Drawing Sheets

FOOD SPILL CATCHING AND SERVING DEVICE

Figure 1:
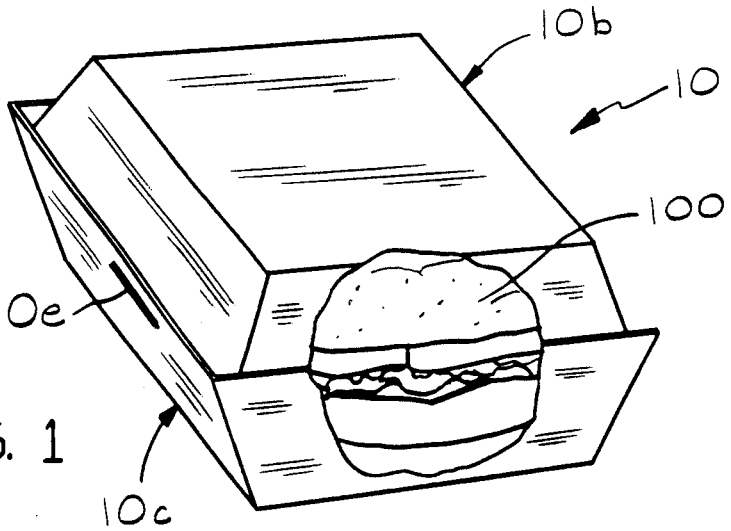

BACKGROUND OF THE INVENTION (1) Field of the Invention

The present invention relates to an improved food spill catching device which can be worn by a person in a moving vehicle to catch the food spills and which is also useful as a serving tray. In particular the present invention relates to a device which can be mass produced at low cost.

(2) Prior Art

My U.S. Pat. No. 4,887,315 describes the prior art. Generally the prior art does not describe a device like that of the present invention.

In my U.S. Pat. No. 4,887,315, I described a preferred unitary preform which was folded to assemble the device. The tray produced performs very well; however, because of the unusual shape of the preform there is considerable wastage of material (paper or plastic) upon cutting.

OBJECTS

It is therefore an object of the present invention to provide an improved food spill catching and serving device which minimizes the loss of material in forming the device. Further, it is an object of the present invention to provide a device which can be produced in high volume and at low cost. These and other objects will become increasingly apparent by reference to the following description and the drawings.

IN THE DRAWINGS

FIG. 1 is a perspective view of the food spill catching and serving device 10 of the present invention as a food serving tray, particularly illustrating the device in a closed condition with a cut-away portion showing a hamburger 100 inside.

Figure 2:
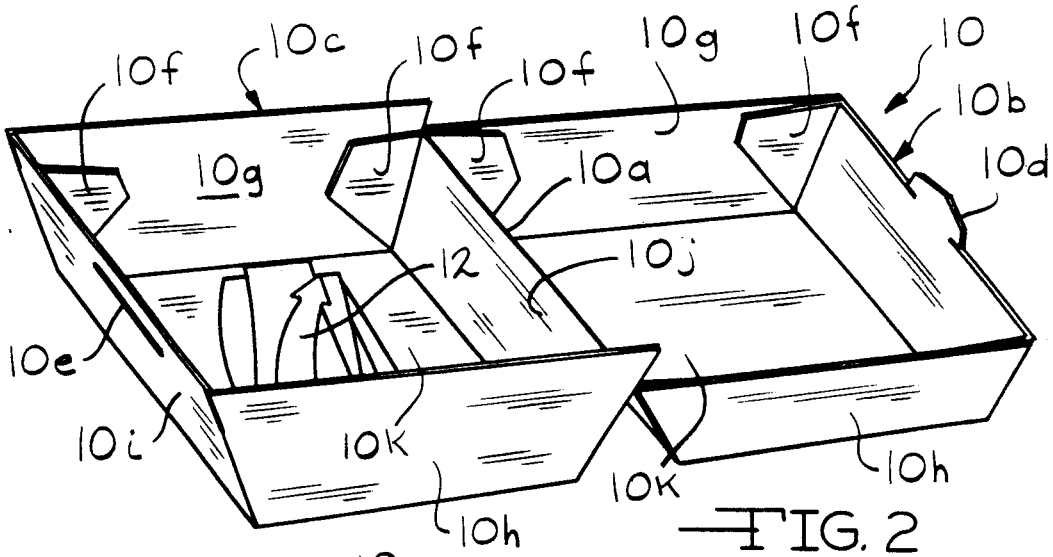

FIG. 2 is a perspective view of the opened device 10 of FIG. 1 with the hamburger 100 removed, particularly illustrating the folded straps 12 in a tray 10*c*.

Figure 3:
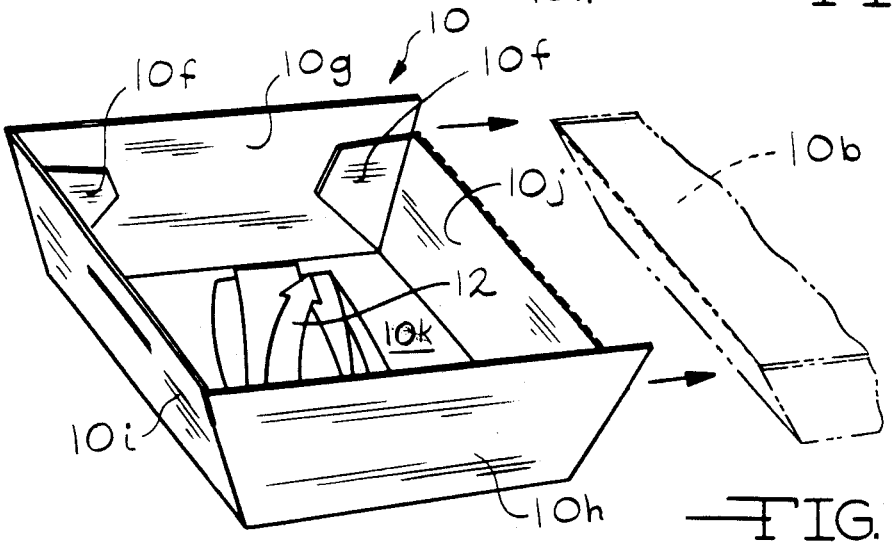

FIG. 3 is a perspective view illustrating a cover tray portion 10*b* of the device 10 removed from a container tray portion 10*c*.

Figure 4:
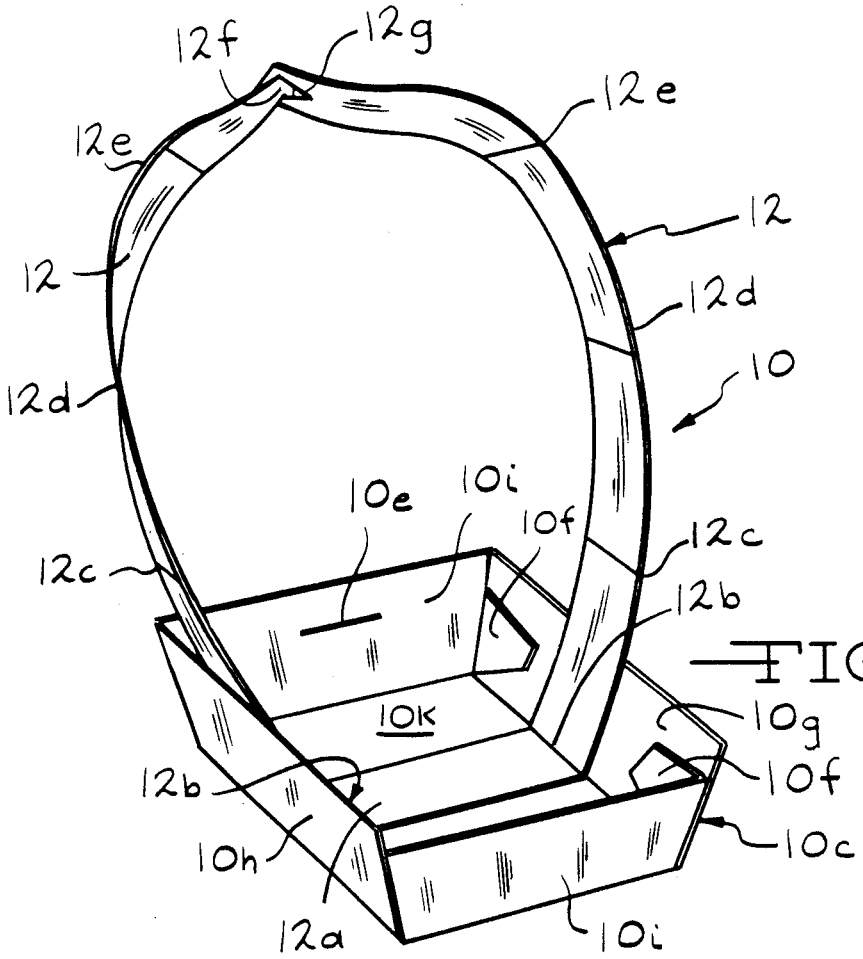

FIG. 4 is a perspective view of the tray portion 10*c* of FIG. 3 assembled as the food spill catching device 10 with the straps 12 in their extended position from the tray portion 10*c* for attaching around the neck of a person.

Figure 5:
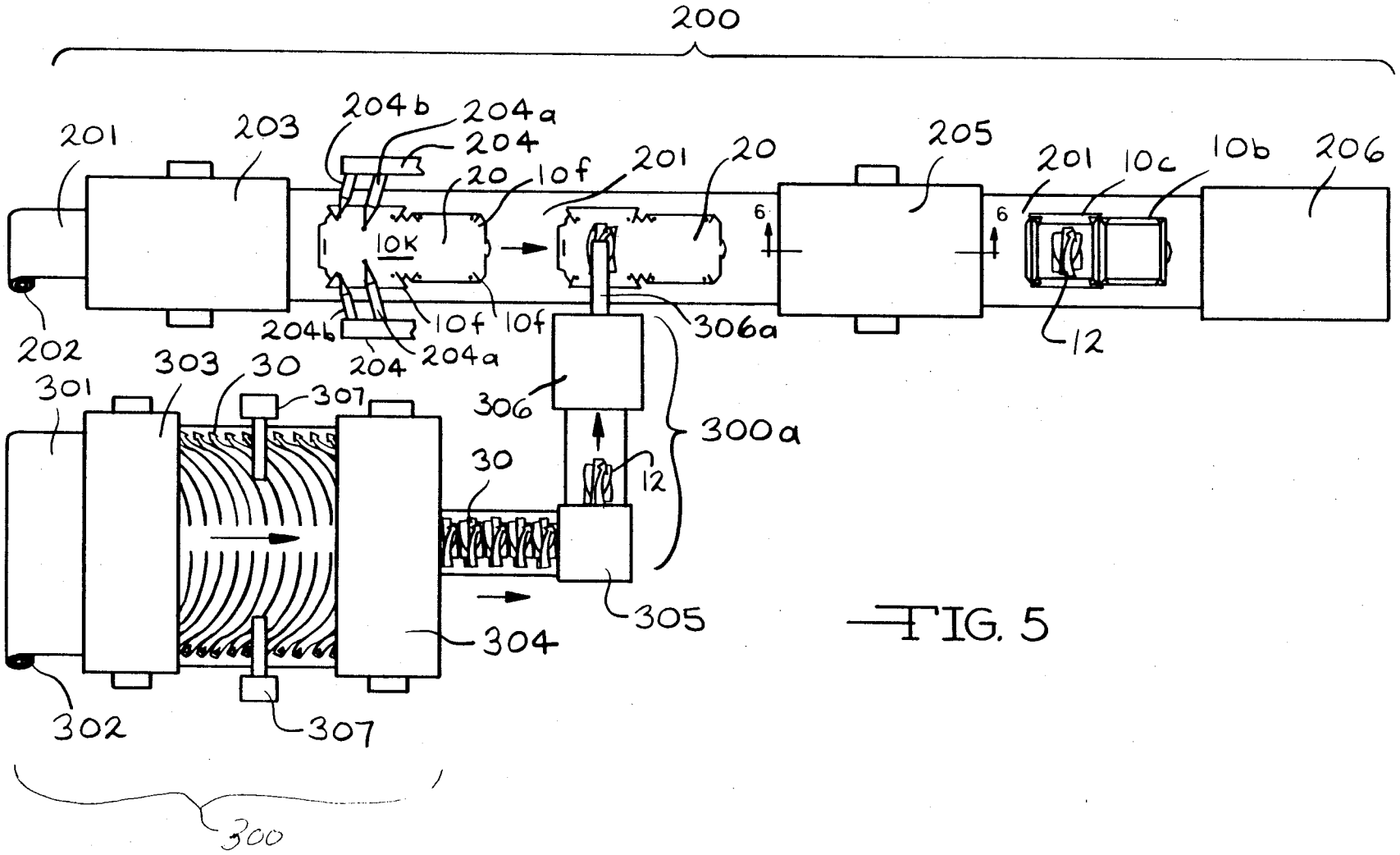

FIG. 5 is a schematic plan view of an apparatus for assembling the food spill catching device 10, particularly illustrating separate lines 200, 300 and 300*a* for cutting, assembling and forming the trays 10*b* and 10*c* and the straps 12.

Figure 6:
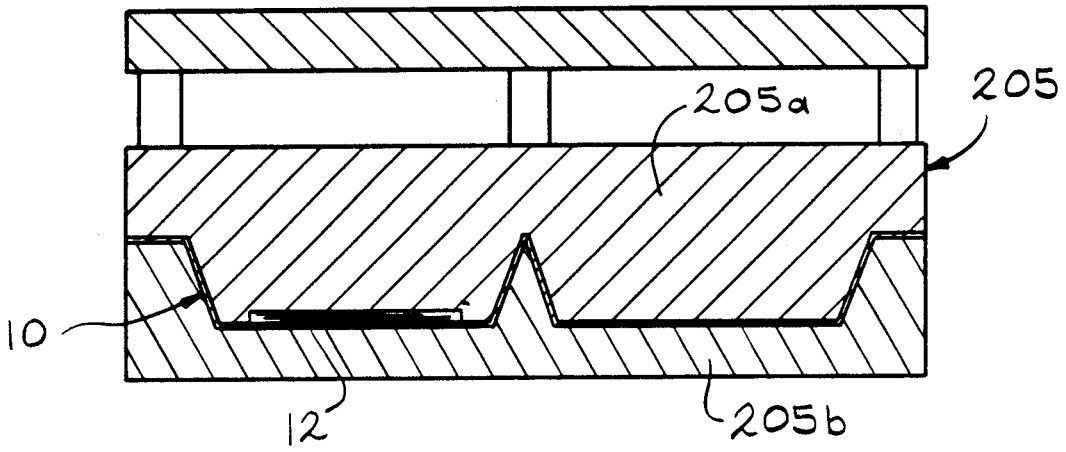

FIG. 6 is a cross-section along line 6-6 of FIG. 5 showing male-female molds unit 205 for compressing the folded straps 12 and trays 10*b* and 10*c* together until a glue holding the straps 12 in the tray 10*c* has set. The trays 10*b* and 10*c* provide a standard double bottom clamshell container.

GENERAL DESCRIPTION

The present invention relates to a protective device for collecting food spills adapted to be positioned on a front body portion of a person in an upper chest area to catch the spills from the mouth of the person which comprises: a rigid tray having a bottom, a front side away from the body portion, a back side adjacent to the upper chest area and opposite ends connecting the sides and the bottom to form the tray with a recess inside the tray for catching spills; and a separate strap means mounted across the bottom of the tray in the recess and adjacent the opposite ends of the tray, which strap means extends to and fastens round the neck of the person, wherein in use food falls from the mouth by gravity into the recess in the tray.

Further, the present invention relates to a method for collecting food spills while seated in a moving vehicle which comprises: providing a protective device adapted to be positioned on a front body portion of a person in an upper chest area which comprises a rigid tray having a bottom, a front side away from the body portion, a back side adjacent the upper chest area and opposite ends connecting the sides and the bottom to form the tray with a recess inside the tray for catching the spills; and a separate strap means mounted on the bottom of the tray in the recess and adjacent the opposite ends of the tray, which strap means extends to and fastens around the neck of the person, wherein in use food falls by gravity from the mouth into the tray while the person is seated in the moving vehicle; mounting the device around the neck using the strap means; collecting the food spills in the recess in the tray; and removing the strap means from around the neck after use.

Finally the present invention relates to a method for providing a protective device for collecting food spills adapted to be positioned on a front body portion of a person in an upper chest area to catch the spills from the mouth of the person which comprises: a rigid tray having a bottom, a front side away from the body portion, a back side adjacent to the upper chest area and opposite ends connecting the sides and the bottom to form the tray with a recess inside the tray for catching spills; and a separate strap means mounted across the bottom of the tray in the recess and adjacent the opposite ends of the tray, which strap means extends to and fastens around the neck of the person, wherein in use food falls from the mouth by gravity into the recess in the tray which comprises: providing a first conveyor line for multiple of the trays; providing a second conveyor line for multiple of the strap means; and mounting the strap means in the recess in the tray at a junction of the first and second conveyor lines.

The straps and tray are formed separately and then assembled. This is in contrast to the preferred unitary preform shown in my U.S. Pat. No. 4,887,315. The result is a considerable savings in material because of reduced wastage.

In the device of the present invention, the strap and tray can, if desired, be cut from different materials. These materials can have a different thickness and/or can be composed of a different material. Thus, for instance, the tray can be made of an expanded polystyrene and the straps can be made of cardboard. Generally the materials are disposable.

Preferably the strap is attached behind the neck. Various attachment means can be used; however, the least expensive is a tab on one strap and a receiving slot on the other strap.

Preferably the device also functions as a server for the food with top and bottom portions. Usually one of the portions is removed, such as by tearing a hinge in a "clam shell" type serving container and is discarded. Prior to use, the devices with the folded straps on the bottom of the trays are stacked for shipment and use.

Most usually the device is constructed for serving hamburgers and the like. In this event, the ratio of length to width between the sides is about equal.

SPECIFIC DESCRIPTION

FIGS. 1 to 4 show the assembled device 10. FIGS. 5 and 6 show the apparatus for assembling the device 10. As shown in FIG. 1, the device 10 is used to contain a hamburger 100 or like food to be dispensed to a customer, usually at a fast food restaurant. Conventionally the device 10 is hinged at 10*a* as shown in FIG. 2. As shown in FIG. 2, the device 10 includes two portions 10*b* and 10*c*. Portion 10*c* functions as a cover herein and portion 10*b* functions as the tray of the present invention. It will be appreciated that either portion 10*b* or 10*c* could be the tray portion 10*b*. Portion 10*b* includes a tab 10*d* which slides into slot 10*e* on the portion 10*c*. Each portion 10*b* and 10*c* includes tabs 10*f* (two shown) glued at each corner to form the portions 10*b* and 10*c*. The tabs 10*f* are glued to lateral sides 10*g* and 10*h* on each portion 10*b* and 10*c*. A front side 10*i* and a rear side 10*j* form the portion 10*c* along with a bottom 10*k*. The front and rear sides 10*j* and 10*i* are designated for convenience of explanation and could be reversed. The rear side 10*i* is positioned adjacent the chest area of the person. The description device 10 to this point is conventional and the trays 10*b* and 10*c* could also be made of molded polystyrene or other plastic material as is known to those skilled in the art.

As can be seen from FIGS. 2 and 3, straps 12 are folded inside the tray 10*c*. In this manner the straps 12 do not interfere with the food being served.

After the food is served, the portions 10*b* and 10*c* are separated along the hinge line 10*a*. This is accomplished easily if the hinge is perforated or has thin cross-section. The straps 12 are then unfolded from the bottom 10*k* of the tray 10*c*. As can be seen portion 12*a* (FIG. 4) of straps 12 is secured, preferably by gluing, to the bottom 10*k* of the tray 10*c*. The straps 12 have fold lines 12*b* (FIG. 4), 12*c*, 12*d* and 12*e* which are identical on each side of the straps 12. The straps 12 include a tab 12*f* which fits into slot 12*g* to hold the straps 12 around the neck of a person (not shown). The device 10 is then used and discarded when the use is complete.

FIGS. 5 and 6 show the apparatus for the manufacture of the device 10. FIG. 5 shows three conveyor lines 200, 300 and 300*a*. The conveyor line 200 conveys the boxboard 201 from a roll 202. A die cutter 203 stamps the preform 20 for the trays 10*b* and 10*c*. Glue is applied by applicator 204 in a position to secure tabs 10*f*. Glue is also applied by the applicator 204*a* to the preform 20 for securing the straps 12 in the portion of the preform 20 which will become the bottom 10*k* of the tray 10*c*.

Conveyor line 300 conveys cardboard 301 from roll 302 to a die cutter 303 which cuts the preform 30 for the straps 12 except the center portion 12*a* is left uncut from adjoining straps 12. The straps 12 are folded in a folding machine 304 to provide creases 12*b* to 12*e*. Glue is applied by applicators 307 so that the straps 12 remain folded. The preform 30 is moved to a second conveyor 300*a* where a cutter 305 severs the attachment at the center portion 12*a*. The single cut and folded strap 12 is then conveyed to line 200 where arm 306*a* of robot 306 mounts the folded strap onto the preform 20 at what will be the bottom 10*k* of the portion 10*c*. The preform 20 and folded strap 12 is then conveyed to a male-female molding unit 205 (FIG. 6) with male die 205*a* and female die 205*b* which forms the trays 10*b* and 10*c* and holds the tabs 10*f* and straps 12 in position until the glue is set. The device 10 is then removed from the mold unit 205 and can be stacked at station 206 for shipment. As can be seen, the present invention provides a means for readily and easily forming the device 10 without wasting cardboard in forming the straps 12. The resulting process produces little waste and is very fast and economical.

It is intended that the foregoing description be only illustrative and that the present invention be limited only by the hereinafter appended claims.

I claim:

1. A protective device for collecting food spills adapted to be positioned on a front body portion of a person in an upper chest area to catch the spills from the mouth of the person which comprises:

(a) a rigid tray having a bottom, a front side away from the body portion, a back side adjacent to the upper chest area and opposite ends connecting the sides and the bottom to form the tray with a recess inside the tray for catching spills; and (b) a strap means formed separately of the tray mounted across the bottom of the tray in the recess and adjacent the opposite ends of the tray, which strap means extends to and fastens around the neck of the person, wherein in use food falls from the mouth by gravity into the recess in the tray.

2. The device of claim 1 wherein the strap means and tray are cut from different materials.

3. The device of claim 1 wherein the strap means has attaching means which fasten behind the neck of the person for securing the device to and unsecuring the device from the neck of the person.

4. The device of claim 3 wherein an end of a first segment of the strap means adjacent the back of the neck of the person is provided with a tab and an end of a second segment of the strap means adjacent the back of the neck is provided with an opening which receives the tab on the first segment of the strap means to thereby support the device on the person.

5. The device of claim 1 wherein the tray is derived from a container for dispensing a food with a top half and a bottom half hinged together and wherein one of the halves of the container separates from the other of the halves to provide the tray.

6. The device of claim 5 wherein the tray has a ratio of length of the sides to width of the ends which is about the same or greater than 1.

7. The device of claim 1 composed of a disposable material.

8. The device of claim 1 wherein the strap means and the trays have each been provided from separate precut sheets of material as preforms and wherein the preforms have been assembled to form the device with the strap means folded on the bottom of the tray.

9. The device of claim 1 wherein the tray is molded.

10. The device of claim 1 wherein multiple of the devices are stacked one on top of each other.

11. The device of claim 1 wherein the strap means is releaseably folded in the recess in the bottom of the tray.

12. A method for collecting food spills while seated in a moving vehicle which comprises:

(a) providing a protective device adapted to be positioned on a front body portion of a person in an upper chest area which comprises a rigid tray having a bottom, a front side away from the body portion, a back side adjacent the upper chest area and opposite ends connecting the sides and the bottom to form the tray with a recess inside the tray for catching the spills; and a strap means formed separately of the tray mounted on the bottom of the tray in the recess and adjacent the opposite ends of the tray which strap means extends to and fastens around the neck of the person, wherein in use food falls by gravity from the mouth into the tray;

(b) mounting the device around the neck using the strap means;

(c) collecting the food spills in the recess in the tray; and (d) removing the strap means from around the neck after use.

13. The method of claim 12 wherein the strap means is releaseably folded in the recess of the tray prior to use and is released for mounting around the neck in use.

* * * * *